US006926141B2

(12) United States Patent
Montler

(10) Patent No.: US 6,926,141 B2
(45) Date of Patent: Aug. 9, 2005

(54) FLEXIBLE HYGIENIC REMOTE CONTROL ENCLOSURE

(76) Inventor: Mike F. Montler, 816 Reinhard Ave., Columbus, OH (US) 43207

( * ) Notice: Subject to any disclaimer, the term of this patent is extended or adjusted under 35 U.S.C. 154(b) by 133 days.

(21) Appl. No.: 10/359,891

(22) Filed: Feb. 6, 2003

(65) Prior Publication Data

US 2004/0154941 A1 Aug. 12, 2004

(51) Int. Cl.[7] ..... B65D 85/00
(52) U.S. Cl. ..... 206/320
(58) Field of Search ..... 206/320, 305, 206/576, 775, 776, 778, 781

(56) References Cited

U.S. PATENT DOCUMENTS

| | | | | | |
|---|---|---|---|---|---|
| 4,149,650 | A | * | 4/1979 | Whelchel et al. | 220/201 |
| 4,733,776 | A | | 3/1988 | Ward | |
| 4,762,227 | A | | 8/1988 | Patterson | |
| 4,836,256 | A | | 6/1989 | Meliconi | |
| 5,080,155 | A | * | 1/1992 | Crozier | 150/154 |
| 5,092,459 | A | | 3/1992 | Uljanic et al. | |
| 5,175,876 | A | * | 12/1992 | Villacis Mendoza | 455/92 |
| 5,265,720 | A | | 11/1993 | Meliconi | |
| 5,316,141 | A | | 5/1994 | Jalomo | |
| 5,499,713 | A | * | 3/1996 | Huffer | 206/320 |
| 5,615,768 | A | | 4/1997 | Schermerhorn | |
| 5,648,757 | A | | 7/1997 | Vernace et al. | |
| 5,812,188 | A | * | 9/1998 | Adair | 348/77 |
| 5,873,456 | A | | 2/1999 | Hull et al. | |
| 5,931,434 | A | | 8/1999 | Rodriguez | |
| 6,050,407 | A | * | 4/2000 | Trujillo | 206/320 |
| 6,105,778 | A | | 8/2000 | Tsai | |
| 6,235,010 | B1 | * | 5/2001 | Wilkinson et al. | 604/356 |
| 6,273,252 | B1 | * | 8/2001 | Mitchell | 206/320 |
| 6,330,430 | B1 | | 12/2001 | Jensfelt | |
| 6,471,056 | B1 | | 10/2002 | Tzeng | |
| 6,525,268 | B1 | * | 2/2003 | Sellers | 174/52.1 |
| 6,659,274 | B2 | * | 12/2003 | Enners | 206/305 |
| 6,772,881 | B2 | * | 8/2004 | Le et al. | 206/305 |

* cited by examiner

*Primary Examiner*—Kurt Fernstrom
(74) *Attorney, Agent, or Firm*—Gallagher & Dawsey Co., LPA; David J. Dawsey; Michael J. Gallagher

(57) ABSTRACT

A flexible hygienic remote control enclosure to protect against contamination of the remote control and to reduce cross contamination between users of the remote control. The remote control is placed through an open end into a flexible, at least partially clear, enclosure. After enclosing the remote control, the open end of the enclosure is closed, and the enclosure is permanently sealed by either adhesive, heat, chemical, mechanical, or other means. The permanent seal makes the enclosure tamper evident, as the enclosure must be stripped off of the remote controller in order to access the controller. The enclosure may be formed of material having antimicrobial qualities to further reduce microbial activity on the surface of the enclosure. The enclosure may be formed with at least one vacuum attachment device to allow removal of fluid, such as air, from the sealed enclosure.

19 Claims, 12 Drawing Sheets

FLEXIBLE HYGIENIC REMOTE CONTROL ENCLOSURE

TECHNICAL FIELD

The instant invention relates to protective covers, particularly to a protective cover for an electronic remote control device.

BACKGROUND OF THE INVENTION

The remote control device has become a ubiquitous part of daily life, serving to control such diverse electronic equipment as televisions and various audio-visual devices. As a result, they tend to be handled by a wide range of persons, using a widely divergent level of care. The remote control device is thus both subject to damage, and likely to become a vector for passing potentially infective agents. This latter problem is particularly acute, as the electrical nature of these devices and their plurality of pushbuttons both act to make cleaning relatively difficult.

Various devices have attempted to deal with aspects of these problems, although none as reasonably and effectively as the instant invention.

First, the issue of damage must be considered from several aspects. A number of devices attempt to prevent impact damage, such as might occur in dropping the remote control device. A prototypical example is U.S. Pat. No. 5,931,434 to Rodriguez. The '434 device provides a peripheral collar type structure around a remote control device designed to resist impact. The utility of such a device is, however, dubious. To begin with, casual experience with remote controls devices will suggest to most users that the units are, in fact, quite resistant to impact damage on their own, and there is little benefit from additional padding. Additionally, such a unit does nothing to confront the main sort of damage a remote control unit is likely to encounter in the real world, the intrusion of dirt or liquids into the unit.

The problem of an electrical device exposed to dirt and liquid is addressed better in such devices as U.S. Pat. No. 5,499,713 to Huffer. The '713 device provides a closable envelope that surrounds a remote control device. However, while such an envelope may protect somewhat against dirt or liquid intrusion, or make the surface easier to clean, the device does little if anything to protect the user of such devices.

A remote control device, especially when found in the homes of large families, or in such multi-user environments as schools, hotels, or hospitals, is handled by a large number of people. Each of the persons who handle the remote control device imparts some level of contamination onto the surface of the device. Providing only an outside envelope, such as the '713 device, does no more than interpose another layer onto the exterior of the device. The potential for contagion is not particularly reduced, nor does the operator have any reliable indication as to the cleanliness state of the device.

Accordingly, the art has needed a means for improving the art of remote control covers. While some of the prior art devices attempted to improve the state of the art of remote control covers, none has achieved the unique and novel configurations and capabilities of the present invention. The present invention makes many improvements over the current state of the art. First, the enclosure is sealed while in use, preventing contamination from reaching the electronic controller. Second, the seal is permanent, making the enclosure tamper evident. Third, being formed of inexpensive materials, soiled covers can be easily stripped off and replaced. At least in some embodiments, the cover is formed from a material having antimicrobial surface qualities. With these capabilities taken into consideration, the instant invention addresses many of the shortcomings of the prior art and offers significant benefits heretofore unavailable. Further, none of the above inventions and patents, taken either singly or in combination, is seen to describe the instant invention as claimed.

SUMMARY OF INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations. An object of this invention is to provide a flexible hygienic remote control enclosure for receiving and housing a wireless remote control device that prevents outside contaminants from reaching the wireless remote control device. Further objects of the invention include, providing a sealed, tamper evident enclosure. In some embodiments, the enclosure is formed from a material exhibiting antimicrobial properties, to reduce microbial growth on the surface of the enclosure In various embodiments, the enclosure is formed having a bottom wall having a peripheral edge, at least one sidewall having at least an inner surface, an outer surface, a distal end, and a proximal end. The distal end is attached to the bottom wall peripheral edge to provide a substantially flat window at the bottom of the enclosure to facilitate the passage of signals from the remote control to the target device. The proximal end is initially open through which the wireless remote control device is inserted. After the remote control device is placed in the enclosure, a closure means permanently seals the wireless remote control device in the enclosure. This makes the enclosure tamper evident, as the enclosure must be stripped off of the remote controller for the controller to be accessed. The inexpensive nature of the instant invention makes frequent replacement economically feasible.

As needed for proper operation of the electronic device to be controlled, in those embodiments utilizing a substantially flat bottom wall, the bottom wall is transparent, at least in part. To allow viewing of the enclosed remote control, at least a portion of the at least one sidewall is transparent. The remainder of the sidewall may be affixed with sidewall indicia, such as, by way of example and not limitation, advertising, television channel information, and the like.

Various embodiments utilize different mechanisms to achieve a permanent seal for the enclosure, permanent meaning in this case a closure that is stronger than the material to which it is attached, and which therefore requires a breaking or tearing of the enclosure in order to release the remote controller. In a first class would be those which achieve a permanent adhesive seal. In one embodiment, closure means includes at least one adhesive securing strip, releasably covered with a removable protective strip, attached to the inner surface of the sidewall between the distal end and the proximal end. The removable protective strip may be removed from the adhesive strip, and the enclosure pressed shut over the adhesive. In another embodiment, the closure means includes a drawstring, which may be pulled tight, closing the opening to the enclosure, and at least one adhesive strip on the drawstring secures the proximal end to the enclosure in a closed position.

In yet another embodiment, the closure means includes a sealing flap having an inner and outer surface, having at least one flap adhesive securing strip on the inner surface, releasably covered with a removable protective strip, flexibly attached to the at least one sidewall outer surface. The drawstring may be pulled tight, closing the opening to the enclosure, the drawstring tucked under the sealing flap, and the sealing flap then sealed down to both contain the drawstring and to prevent opening of the enclosure. Similar to those embodiments where printed indicia is affixed on the sidewall of the enclosure, the use of a sealing flap allows the outer surface of the sealing flap to be affixed with indicia.

As an alternative to the use of permanent adhesives to seal the enclosure, a second class of permanent closure utilizes various mechanical means to seal the enclosure. In one embodiment, the closure means includes a locking mechanical closure arranged to crimp and permanently seal the enclosure.

It is envisioned that the enclosure will function well with a small amount of residual air trapped within the sealed enclosure, however, in one embodiment, at least one vacuum attachment device is attached to the at least one sidewall to remove fluid, by way of example and not limitation, entrapped air, from the enclosure. Removal of this entrapped air will tend to cause atmospheric pressure to collapse the enclosure around the remote controller, giving a tighter and more form fitting aspect to the enclosure in use.

In commercial applications, the enclosure may be sealed with a vacuum device and heat seal apparatus, such as might be carried on a housekeeper's cart. Additionally, sealing could be accomplished by various chemical processes, as would be understood by one skilled in the art. In all of the embodiments described herein, the enclosure may be supplied in a limited number of sizes and shapes. The various sealing mechanisms described allow some degree of customization to the size of the remote controller enclosed, and in various embodiments, excess enclosure material outside of the permanent closure may often be cut off and discarded.

The hygienic aspects of the enclosure are principally achieved by protecting the remote controller from direct contamination, improved ease of cleaning the smooth external surface of the enclosure, and the ease and inexpensive basis with which soiled enclosures may be stripped off and removed. However, in one embodiment, the at least one sidewall and the bottom wall include an antimicrobial agent, wherein the antimicrobial agent may form a surface coating and which may exhibit migration through the at least one sidewall and the bottom wall as the surface coating of antimicrobial agent is depleted.

As an alternative to the above embodiments utilizing a sidewall and bottom wall construction, the enclosure may be formed into a pouch with an open end to receive the controller. After the controller is placed within the pouch, the same closure means, including, but not limited to, adhesive, chemical, thermal, and mechanical, detailed in the embodiments described herein, may be used to permanently seal the enclosure. Similarly to the above, in the pouch style embodiment, at least one vacuum attachment device may be attached to the pouch to remove fluid from the enclosure, and the pouch may be formed of antimicrobial material.

In an alternative construction, the enclosure may be formed with at least one sidewall, wherein the inner surface of the sidewall is circumferentially attached to itself substantially at the distal end, forming a bottom wall. As with preceding embodiments, the proximal end is initially open through which the wireless remote control device is inserted, and a closure means permanently seals the wireless remote control device in the enclosure. The same variations in partial transparency, closure mechanisms, locations for imprinting of printed indicia, and antimicrobial qualities of the enclosure are possible, as with the preceding embodiments.

The instant invention enables a significant advance in the state of the art. The preferred embodiments of the apparatus accomplish this by new and novel arrangements of elements that are configured in unique and novel ways and which demonstrate previously unavailable but preferred and desirable capabilities.

It is to be understood, however, that the same or equivalent functions and features may be accomplished by different embodiments that are also intended to be encompassed within the spirit and scope of the invention.

BRIEF DESCRIPTION OF THE DRAWINGS

Without limiting the scope of the present invention as claimed below and referring now to the drawings and figures:

Also, in the various figures and drawings, the following reference symbols and letters are used to identify the various elements described herein below in connection with the several figures and illustrations: RC.

DETAILED DESCRIPTION OF THE INVENTION

The flexible hygienic remote control enclosure of the instant invention enables a significant advance in the state of the art. The preferred embodiments of the apparatus accomplish this by new and novel arrangements of elements that are configured in unique and novel ways and which demonstrate previously unavailable but preferred and desirable capabilities.

The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Figure 1:
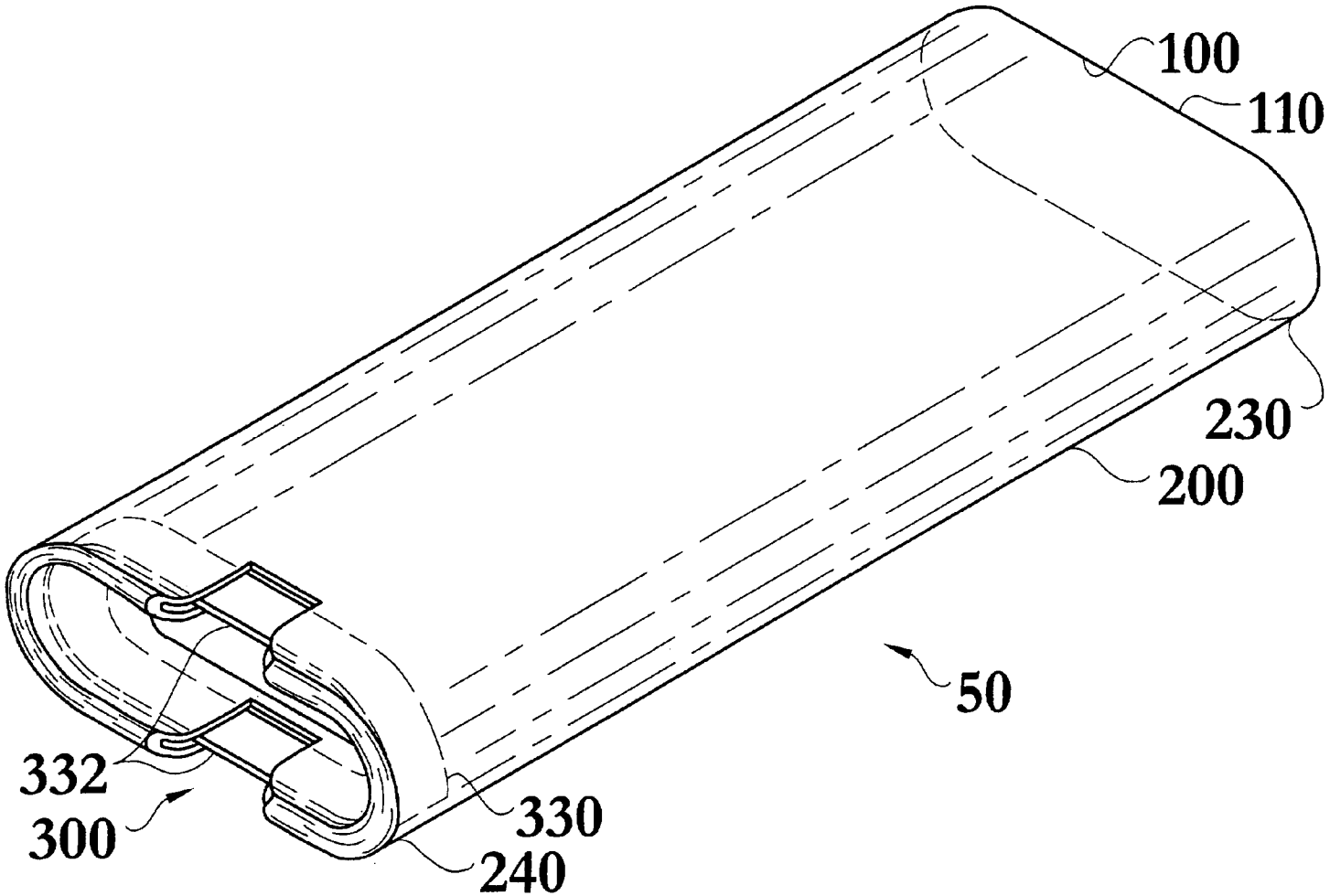
FIG. 1 shows a flexible hygienic remote control enclosure in elevated perspective view, not to scale.
Figure 2:
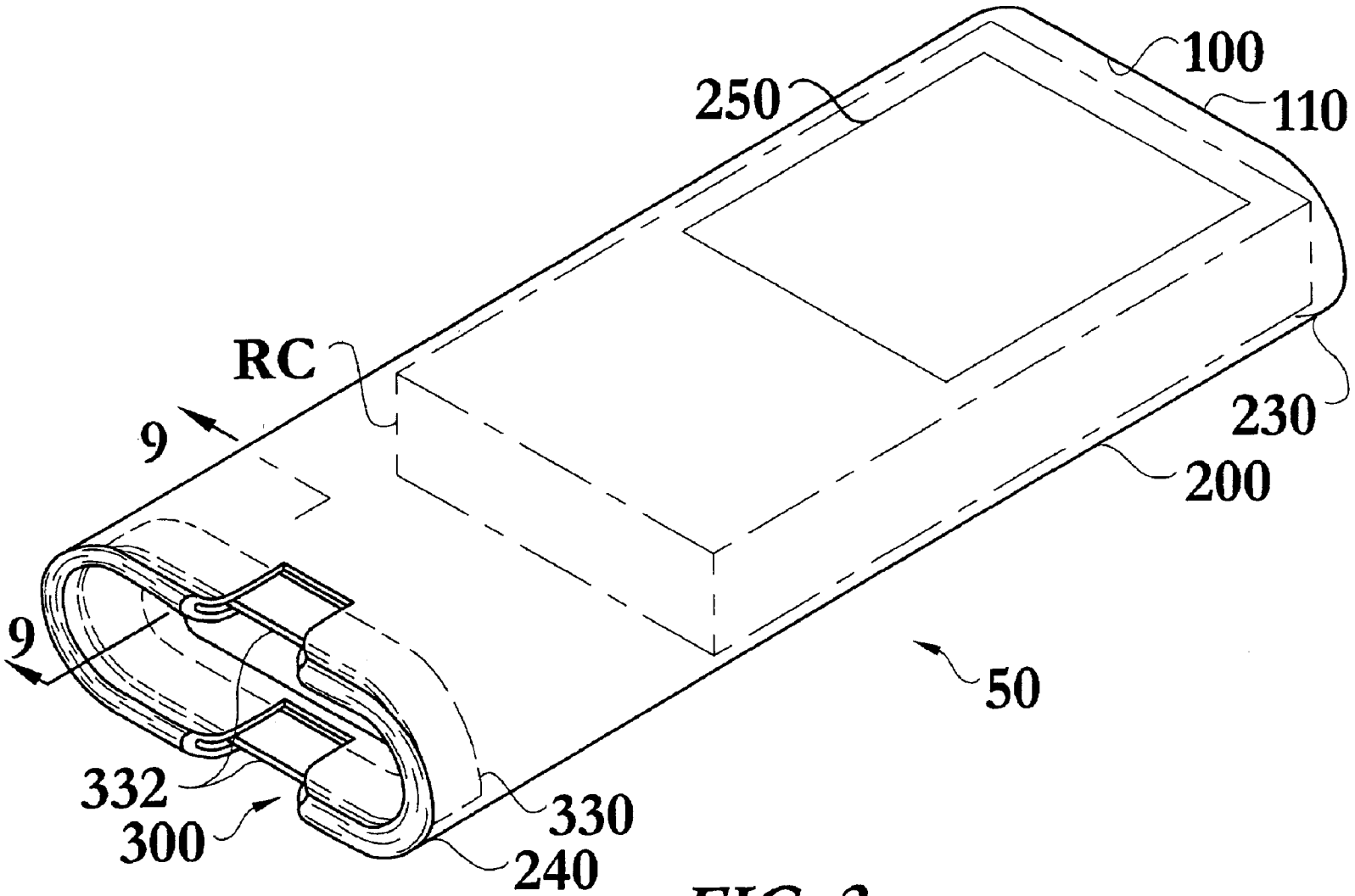
FIG. 2 shows the flexible hygienic remote control enclosure of FIG. 1, enclosing a remote controller, in elevated perspective view, not to scale.
Figure 9:
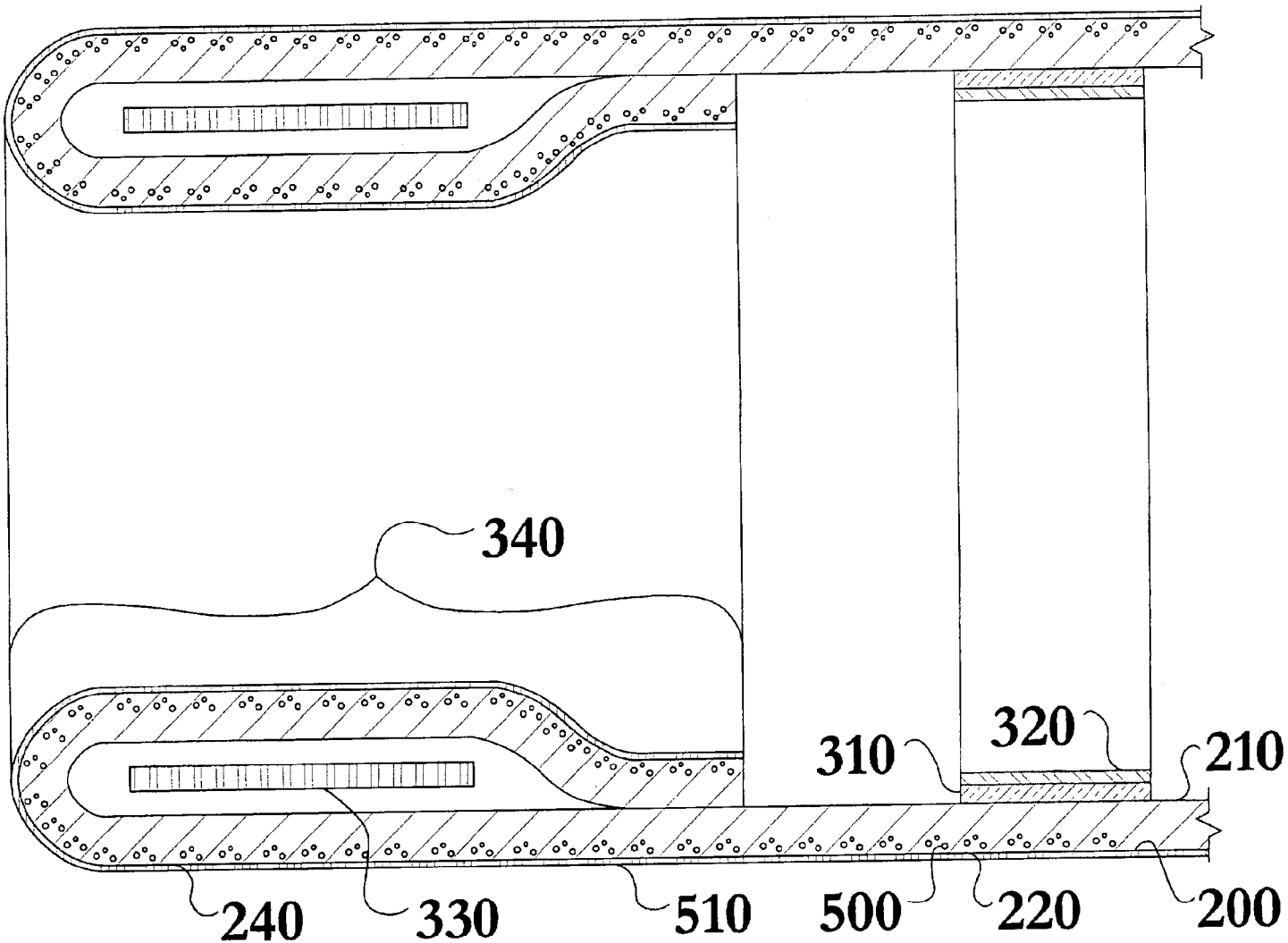
FIG. 9 shows a cross section, in enlarged scale, taken through section line 9—9 of FIG. 2.

In a basic embodiment, seen in FIGS. 1, 2, and 9, a flexible hygienic remote control enclosure 50 for receiving and housing a wireless remote control device RC comprises a bottom wall 100 having a peripheral edge 110, at least one sidewall 200 having at least an inner surface 210, an outer surface 220, a distal end 230, and a proximal end 240. The distal end 230 is attached to the bottom wall peripheral edge 110 and the proximal end 240 is initially open, through which the wireless remote control device RC is inserted. A closure means 300 is provided to permanently seal the wireless remote control device RC in the enclosure 50.

In some embodiments, the bottom wall 100 is at least in part transparent, in order to facilitate the passage of signals from the remote controller RC, and at least a portion of the at least one sidewall 200 is transparent. At least a portion of the at least one sidewall 200 may be affixed with sidewall indicia 250, as shown in FIG. 2, including, by way of example and not limitation, advertising, television channel information, and the like.

Figure 3:
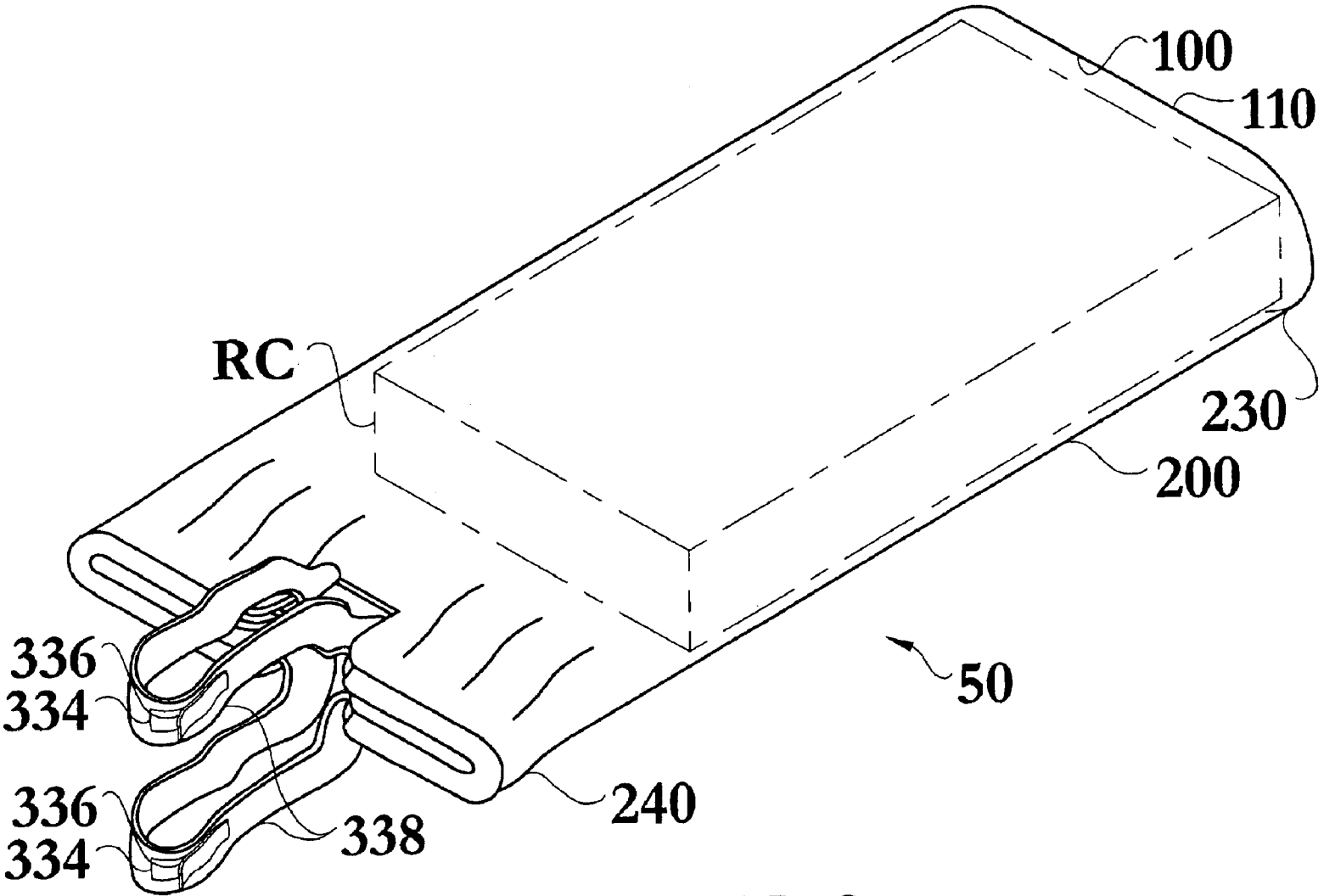
FIG. 3 shows a variation in the flexible hygienic remote control enclosure of FIG. 2 in elevated perspective view, not to scale.
Figure 4:
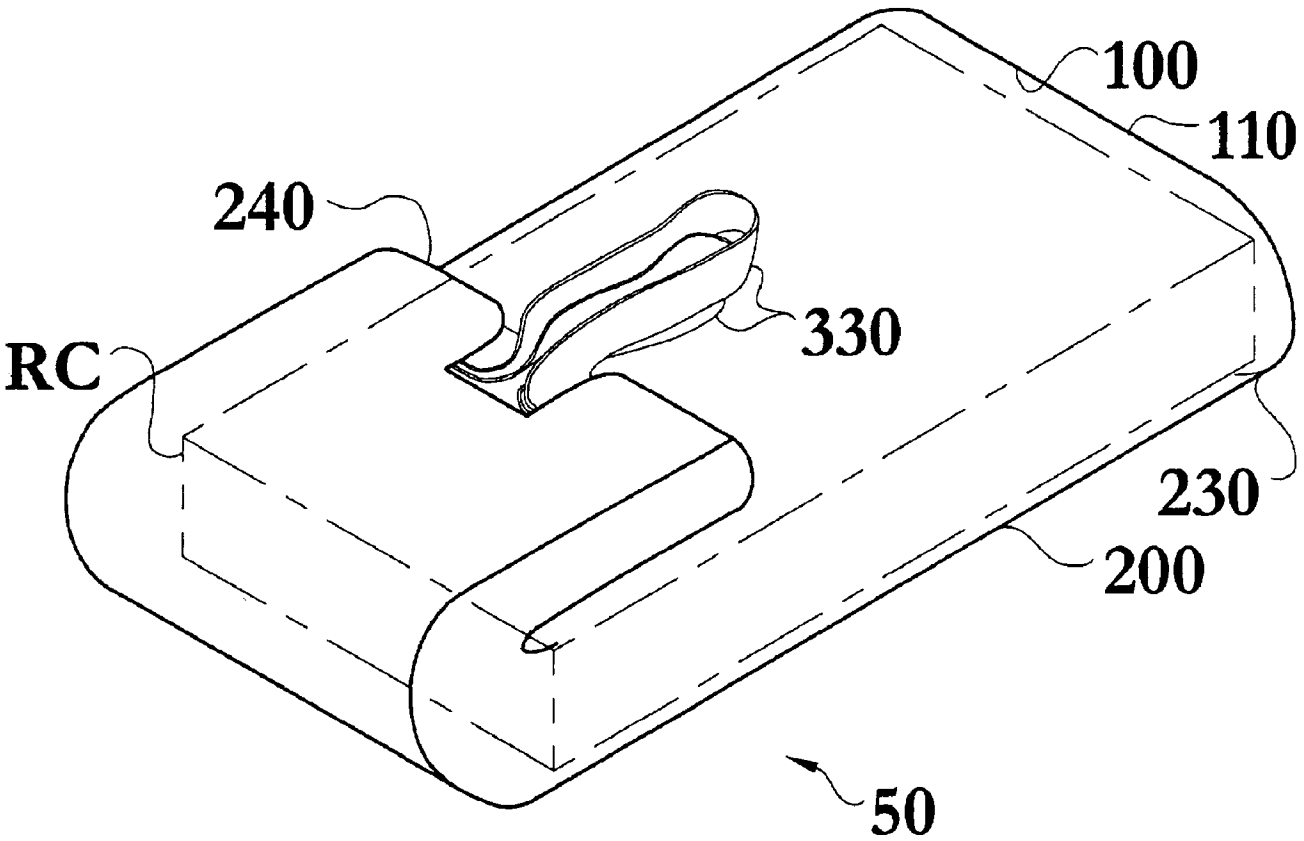
FIG. 4 shows a variation in the flexible hygienic remote control enclosure of FIG. 2 in a sealed position, in elevated perspective view, not to scale.
Figure 5:
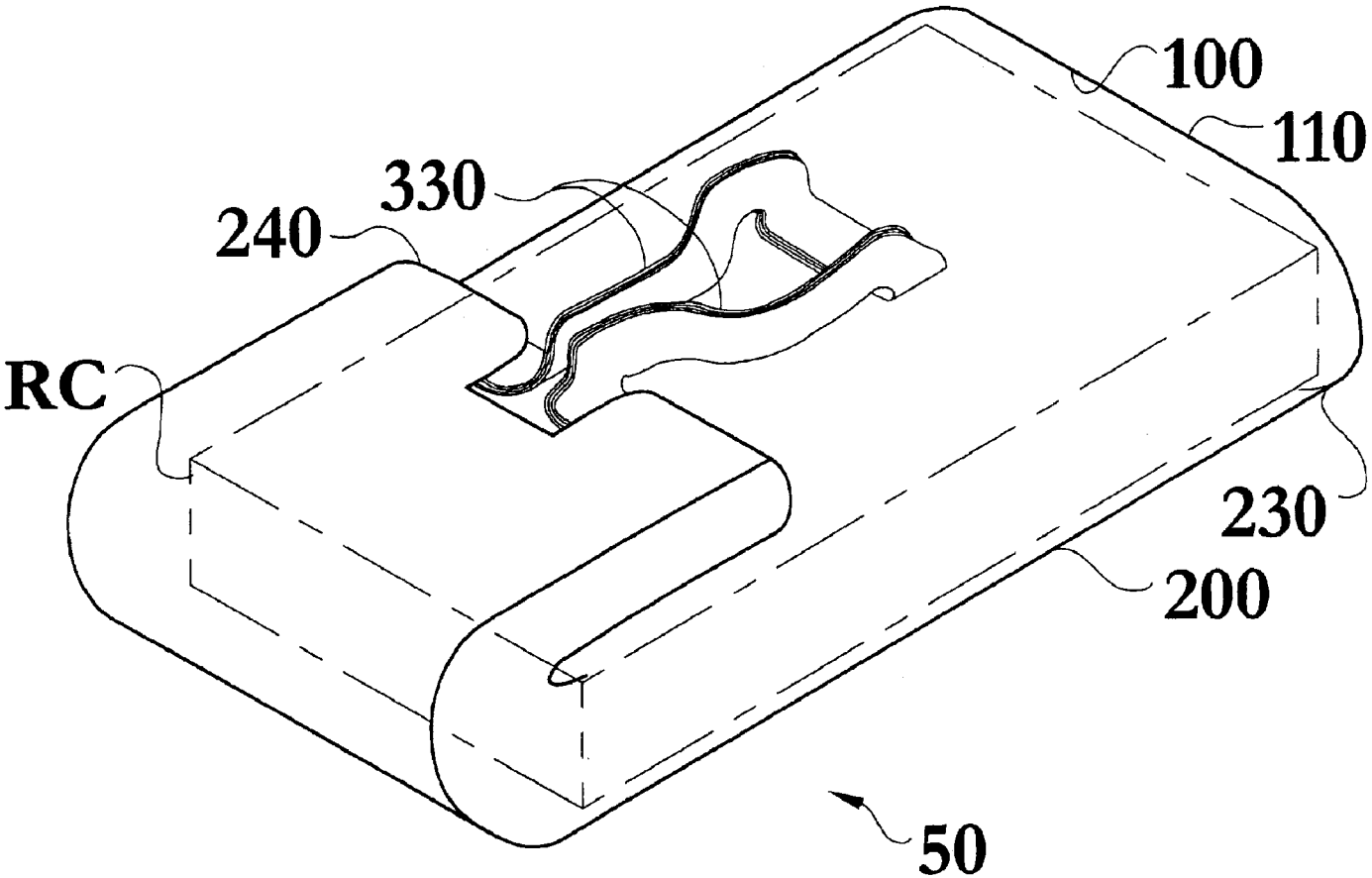
FIG. 5 shows a variation in the flexible hygienic remote control enclosure of FIG. 2 in a sealed position, in elevated perspective view, not to scale.

The permanent closure means 300 may, in general, be adhesive, chemical, thermal, or mechanical in nature, permanent meaning in this case a closure that is stronger than the material to which it is attached, and which therefore requires a breaking or tearing of the enclosure 50 in order to release the remote controller RC. In one embodiment, referring now to FIG. 9, the closure means 300 includes at least one adhesive securing strip 310, releasably covered with a removable protective strip 320, attached to the inner surface 210 of the sidewall 200 between the distal end 230 and the proximal end 240. The closure means 300 may include at least one drawstring 330, as seen in FIGS. 2 and 9, having at least one engagement portion 332, slideably housed in a drawstring housing 340, with the at least one engagement portion 332 accessible, whereby the drawstring housing 340 is attached substantially near to the at least one sidewall proximal end 240. By way of example, and not limitation, in one simple embodiment illustrated in FIG. 9, the attachment of the drawstring housing 340 is formed by folding under and affixing a portion of the proximal end 240 to create a potential space to hold the drawstring 330. The drawstring 330 may have at least one drawstring adhesive securing strip 334 releasably covered with a removable protective strip 336, as seen in FIG. 3 with the enclosure 50 with the proximal end 240 open. The enclosure 50 may be closed, whereby the at least one sidewall proximal end 240 is drawn closed when the at least one drawstring 330 is drawn to a cinched position 338, seen in FIGS. 3 and 4, and the drawstring adhesive securing strip 334 is secured to the enclosure 50, as seen in FIG. 5.

Figure 6:
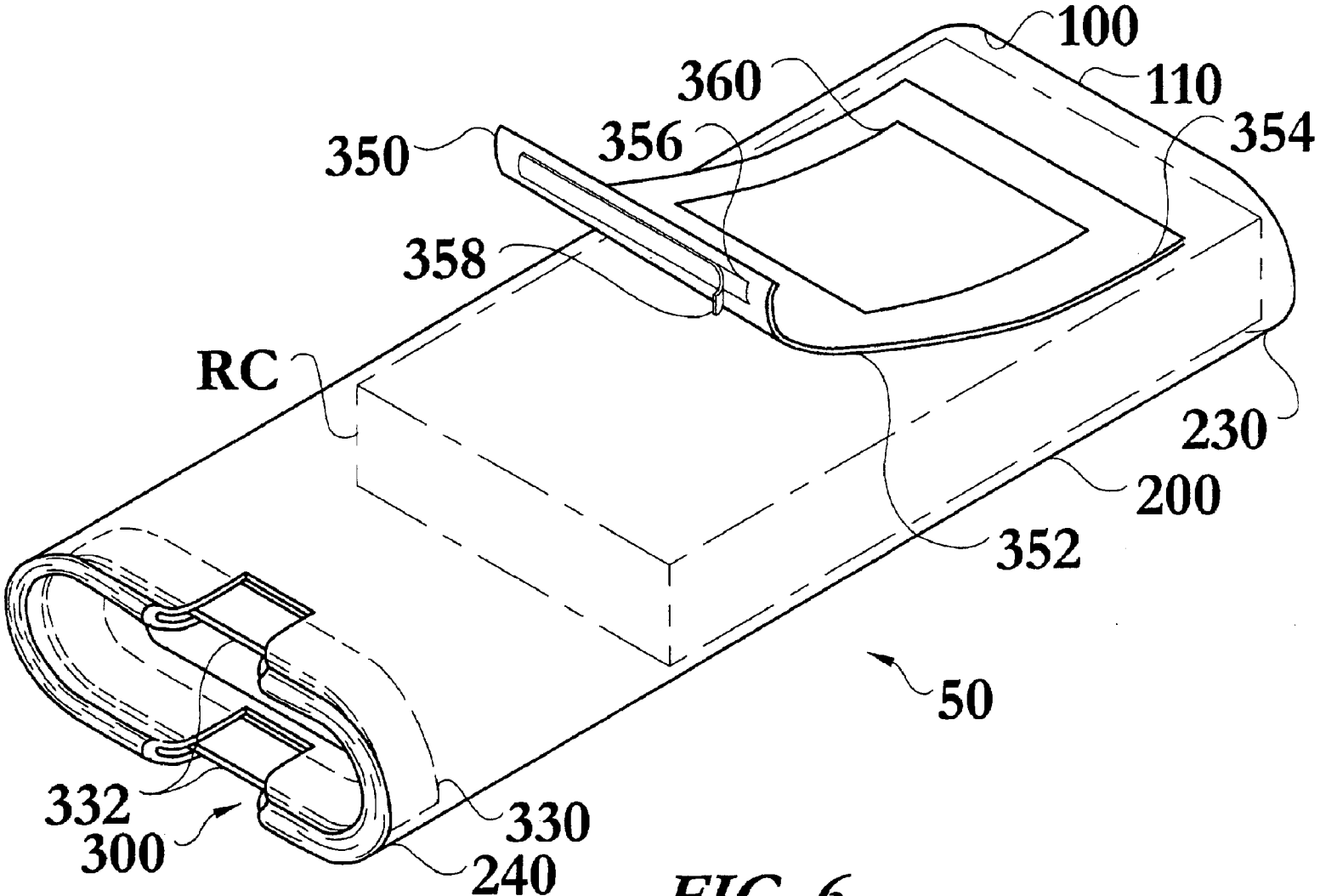
FIG. 6 shows a variation in the flexible hygienic remote control enclosure of FIG. 2, in elevated perspective view, not to scale.
Figure 7:
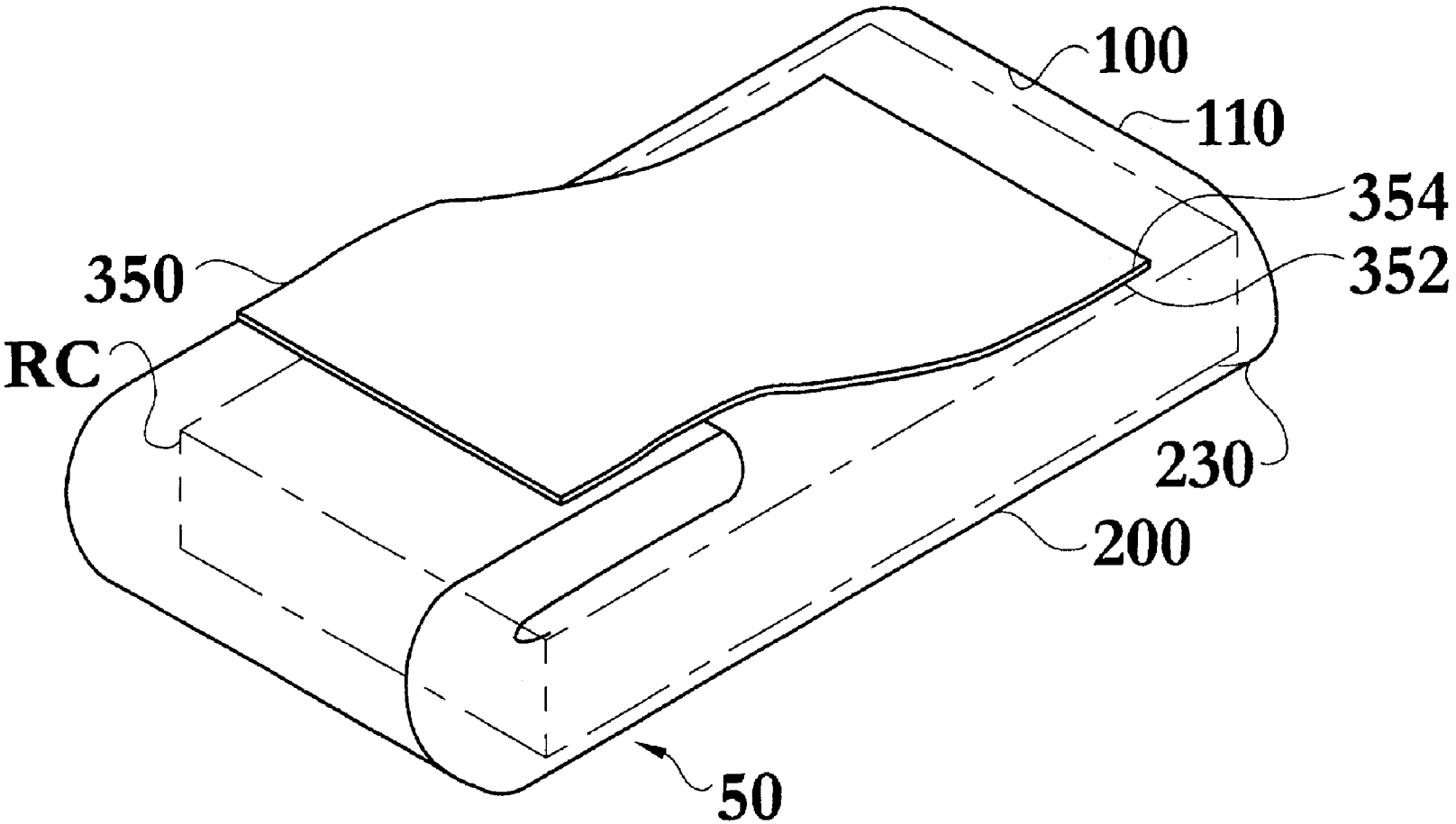
FIG. 7 shows a variation in the flexible hygienic remote control enclosure of FIG. 6 in a sealed position, in elevated perspective view, not to scale.

In another embodiment utilizing adhesive closure, and referring now to FIG. 6, the closure means 300 includes a sealing flap 350 having an inner surface 352 and an outer surface 354, having at least one flap adhesive securing strip 356 on the inner surface 352, releasably covered with a removable protective strip 358, flexibly attached to the at least one sidewall outer surface 220. The sealing flap 350 secures the proximal end 240 and prevents the drawstring 330 from being opened to expose the remote controller RC. The outer surface 354 of the sealing flap 350 may be affixed with flap indicia 360, such as, by way of example and not limitation, advertising, television channel information, and the like.

Figure 8:
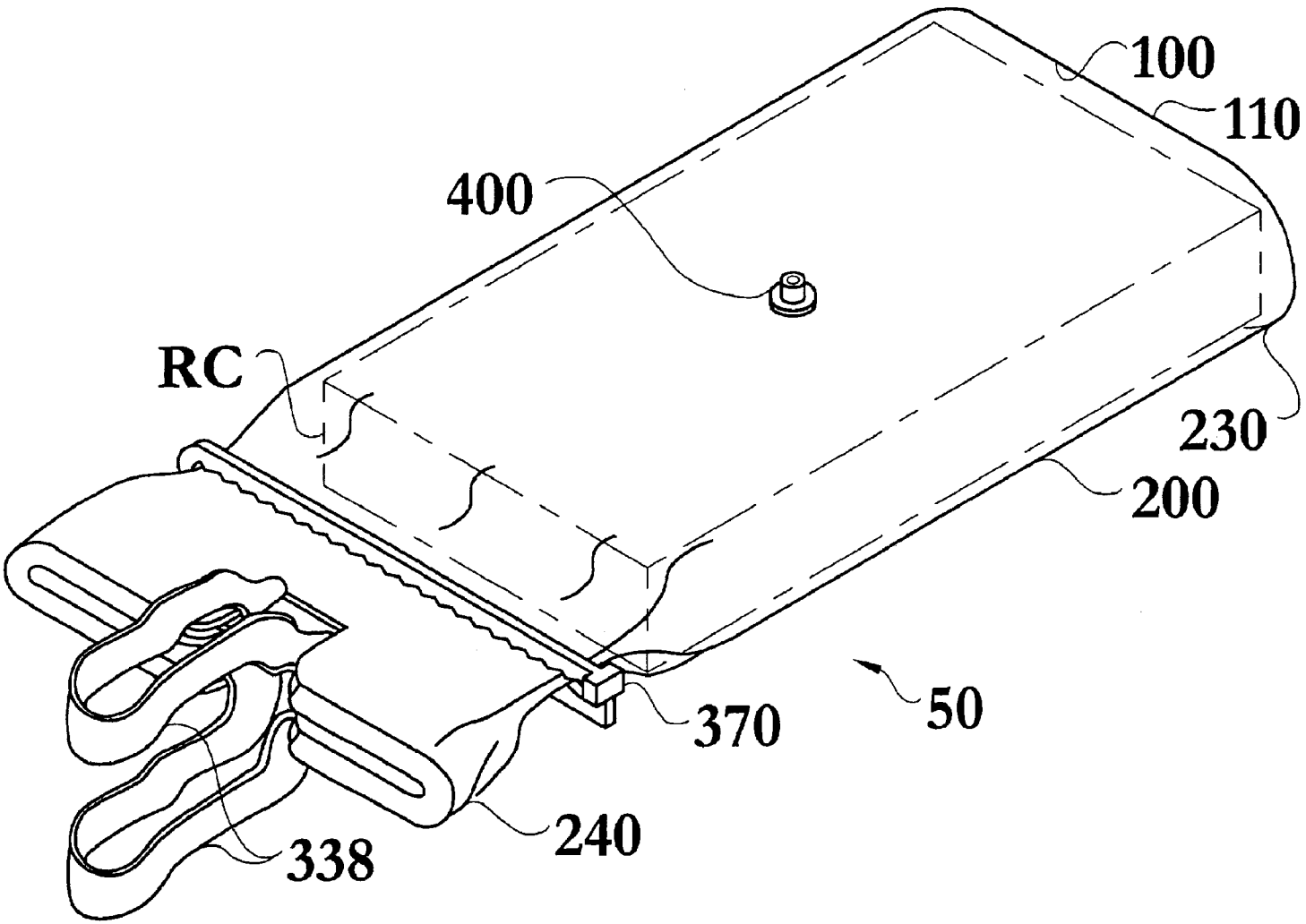
FIG. 8 shows a variation in the flexible hygienic remote control enclosure of FIG. 2 in a sealed position, in elevated perspective view, not to scale.

Alternatively, and referring now to FIG. 8, the permanent closure means 300 may be mechanical in nature. In one such embodiment, the closure means 300 includes a locking mechanical closure 370 arranged to crimp and permanently seal the enclosure 50.

Regardless of the means utilized to effect permanent closure, the flexible hygienic remote control enclosure 50 may further include at least one vacuum attachment device 400 attached to the at least one sidewall 200 to remove fluid such, by way of example and not limitation, air, from the enclosure 50. In any of the herein mentioned embodiments, the at least one sidewall 200 and the bottom wall 100 of the flexible hygienic remote control enclosure 50 may include an antimicrobial agent 500, which may form a surface coating 510 on the at least one sidewall 200 and the bottom wall 100, and the antimicrobial agent 500 may exhibit migration through the at least one sidewall 200 and the bottom wall 110 as the surface coating 510 of antimicrobial agent 500 is depleted.

Figure 10:
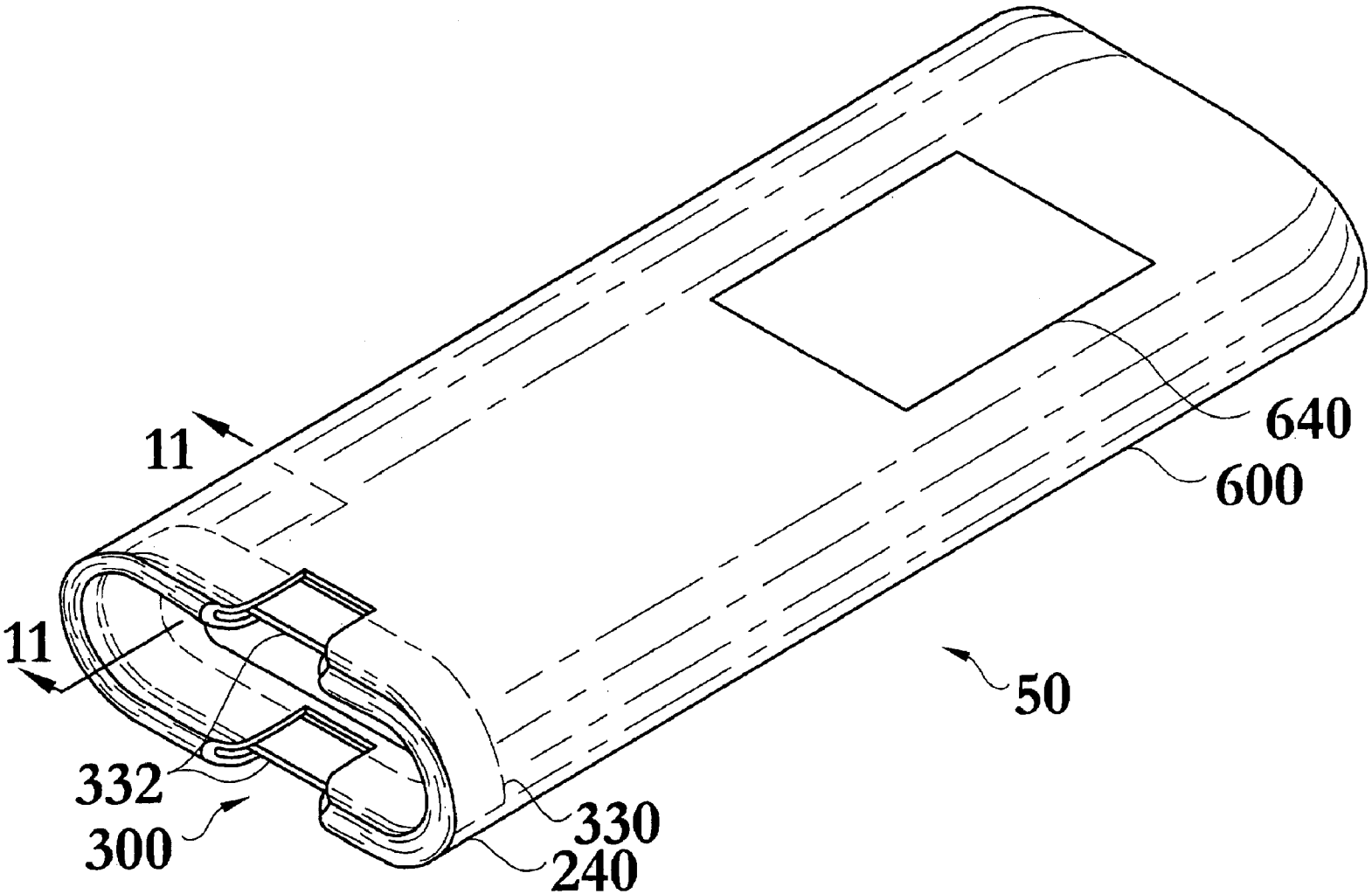
FIG. 10 shows a variation in the flexible hygienic remote control enclosure of FIG. 2, in elevated perspective view, not to scale.
Figure 11:
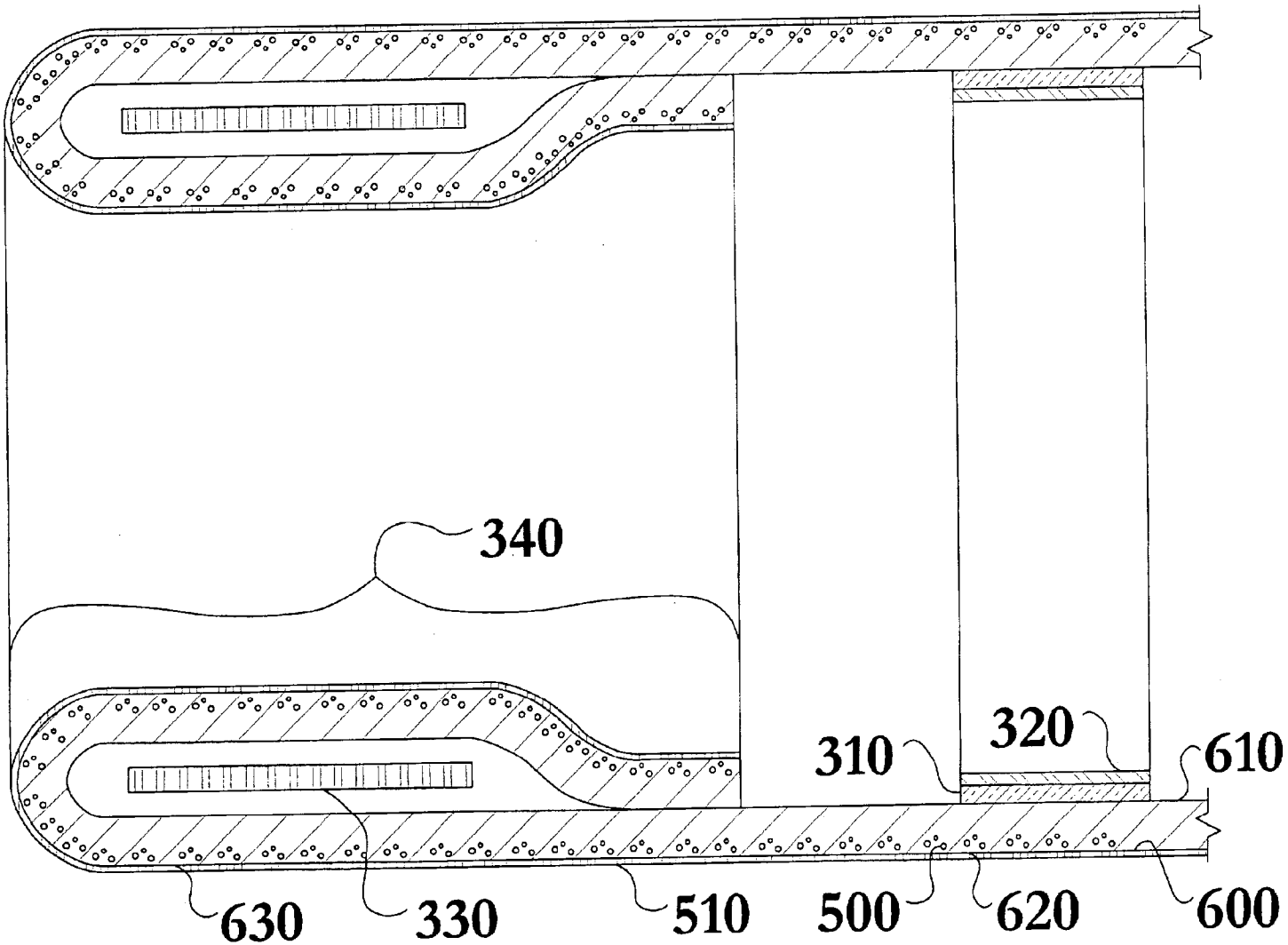
FIG. 11 shows a cross section, in enlarged scale, taken through section line 11—11 of FIG. 10.

Alternatively, referring now to FIGS. 10 and 11, the flexible hygienic remote control enclosure 50 for receiving and housing a wireless remote control device RC may be formed as a pouch 600 having an inner surface 610, an outer surface 620, and a proximal end 630, whereby the proximal end 630 is initially open through which the wireless remote control device RC is inserted; and, as above, a closure means 300 to permanently seal the wireless remote control RC device in the enclosure 50.

As with the other embodiments discussed above, the pouch 600, seen in FIGS. 10 and 11, may utilize a drawstring 330 and drawstring housing 340 closure, as illustrated in FIGS. 1, 2, 3, 4, 5, 6, and 7. The pouch 600 may have at least one adhesive strip 310, seen in FIG. 11, or locking mechanical closure 370, seen in FIG. 8, at the proximal end 630 of the pouch 600. The pouch 600 may be provided with at least one vacuum attachment device 400 attached to the pouch 600 to remove fluid such as, by way of example and not limitation, air, from the enclosure. As illustrated in FIG. 11, the pouch 600 may include an antimicrobial agent 500, and the antimicrobial agent 500 may form a surface coating 510 on the pouch. The antimicrobial agent 500 may exhibit migration through the pouch 600 as the surface coating 510 of antimicrobial agent 500 is depleted. The pouch 600 may be affixed with pouch indicia 640.

Figure 12:
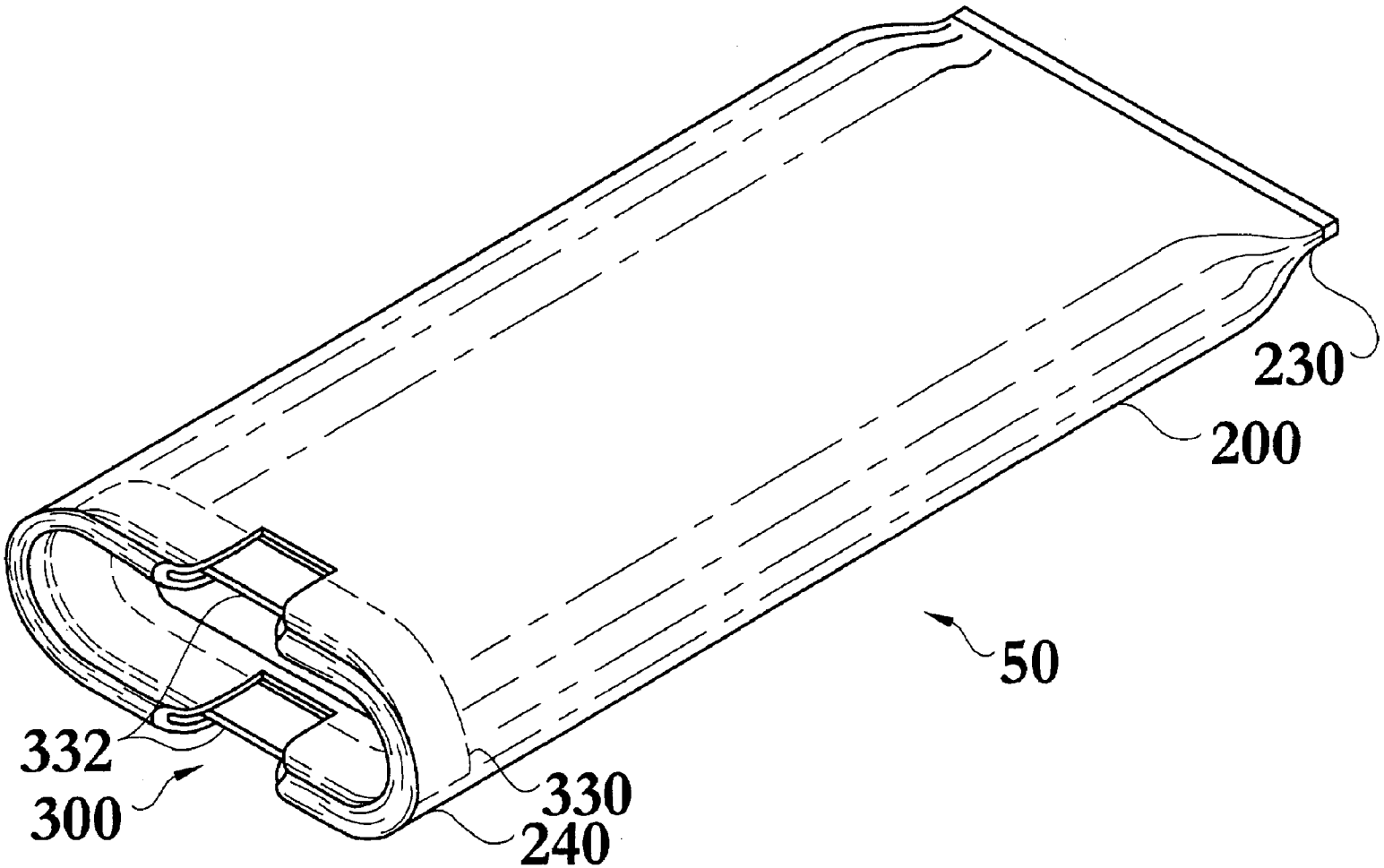
FIG. 12 shows a variation in the flexible hygienic remote control enclosure of FIG. 2, in elevated perspective view, not to scale.

As an alternative to the embodiments detailed above, and referring now to FIG. 12, the flexible hygienic remote control enclosure 50 for receiving and housing a wireless remote control device RC, may comprise at least one sidewall 200 having, as seen in FIGS. 1, 2, 3, and 4, at least an inner surface 210, an outer surface 220, a distal end 230, and a proximal end 240, whereby the inner surface 210 is circumferentially attached to itself substantially at the distal end 230 forming a bottom wall 110. The proximal end 240 is initially open through which the wireless remote control device RC is inserted; and a closure means 300 permanently seals the wireless remote control device RC in the enclosure 50.

As with the other embodiments discussed, in this embodiment, at least a portion of the at least one sidewall 200 may be at least in part transparent, and at least a portion of the at least one sidewall 200 may be affixed with sidewall indicia 250.

Similar to the closure means seen in other embodiments, in this embodiment, the closure means 300 may include the same closure means 300 as seen in other embodiments herein. The closure means 300 may include at least one adhesive securing strip 310, as seen in FIG. 9, releasably covered with a removable protective strip 320, attached to the inner surface 210 of the at least one sidewall 200 between the distal end 230 and the proximal end 240. Alternatively, the closure means 300 may include at least one drawstring 330, as seen in FIGS. 1, 2, and 3, having at least one engagement portion 332, slideably housed in a drawstring housing 340 with the at least one engagement portion 332 accessible, whereby the drawstring housing 340 is attached substantially near to the at least one sidewall proximal end 240. Variations include having at least one drawstring adhesive securing strip 334 releasably covered with a removable protective strip 336, as seen in FIG. 3, whereby the at least one sidewall proximal end 240 is drawn closed when the at least one drawstring 330 is drawn to a cinched position 338, seen in FIGS. 3 and 4, and the drawstring adhesive securing strip 334 is secured to the enclosure 50, as seen in FIG. 5.

Alternatively, this embodiment may use closure means 300 such as seen in FIG. 6, the closure means 300 including a sealing flap 350 having an inner surface 352 and an outer surface 354, having at least one flap adhesive securing strip 356 on the inner surface 352, releasably covered with a removable protective strip 358, flexibly attached to a portion of the outer surface 220 of the at least one sidewall 200.

These variations, modifications, alternatives, and alterations of the various preferred embodiments, arrangements, and configurations may be used alone or in combination with one another as will become more readily apparent to those with skill in the art with reference to the following detailed description of the preferred embodiments and the accompanying figures and drawings.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims.

I claim:

1. A flexible hygienic remote control enclosure for receiving and housing a wireless remote control device, comprising:

a bottom wall having a peripheral edge;

at least one sidewall having at least an inner surface, an outer surface, a distal end, and a proximal end, whereby the distal end is attached to the bottom wall peripheral edge and the proximal end is initially open through which the wireless remote control device is inserted, wherein the at least one sidewall and the bottom wall include an antimicrobial agent; and a closure means to permanently seal the wireless remote control device in the enclosure.

2. The flexible hygienic remote control enclosure of claim 1, wherein the bottom wall is at least in part transparent.

3. The flexible hygienic remote control enclosure of claim 1, wherein at least a portion of the at least one sidewall is affixed with sidewall indicia.

4. The flexible hygienic remote control enclosure of claim 1, wherein the closure means includes at least one adhesive securing strip, releasably covered with a removable protective strip, attached to the inner surface of the sidewall between the distal end and the proximal end.

5. The flexible hygienic remote control enclosure of claim 1, wherein the closure means includes at least one drawstring, having at least one engagement portion, slideably housed in a drawstring housing with the at least one engagement portion accessible, whereby the drawstring housing is attached to the at least one sidewall proximal end, and having at least one drawstring adhesive securing strip releasably covered with a removable protective strip, whereby the at least one sidewall proximal end is drawn closed when the at least one drawstring is drawn to a cinched position.

6. The flexible hygienic remote control enclosure of claim 1, wherein the closure means includes a sealing flap having an inner and outer surface, having at least one flap adhesive securing strip on the inner surface, releasably covered with a removable protective strip, flexibly attached to the at least one sidewall outer surface.

7. The flexible hygienic remote control device of claim 6, wherein the outer surface of the sealing flap is affixed with flap indicia.

8. The flexible hygienic remote control enclosure of claim 1, wherein the closure means includes a locking mechanical closure ranged to crimp and permanently seal the enclosure.

9. The flexible hygienic remote control enclosure of claim 1, further including at least one vacuum attachment device attached to the at least one sidewall to remove fluid from the enclosure.

10. The flexible hygienic remote control enclosure of claim 1, wherein the antimicrobial agent forms a surface coating on the at least one sidewall and the bottom wall and the antimicrobial agent exhibits migration through the at least one sidewall and the bottom wall as the surface coating of antimicrobial agent is depleted.

11. A flexible hygienic remote control enclosure for receiving and housing a wireless remote control device, comprising:

a pouch having an inner surface, an outer surface, and a proximal end, whereby the proximal end is initially open through which the wireless remote control device is inserted, wherein the pouch includes an antimicrobial agent; and a closure means to permanently seal the wireless remote control device in the enclosure.

12. The flexible hygienic remote control enclosure of claim 11, wherein the closure means includes a locking mechanical closure arranged to crimp and permanently seal the enclosure.

13. The flexible hygienic remote control enclosure of claim 11, further including at least one vacuum attachment device attached to the pouch to remove fluid from the enclosure.

14. The flexible hygienic remote control enclosure of claim 11, wherein the antimicrobial agent forms a surface coating on the pouch and the antimicrobial agent exhibits migration through the pouch as the surface coating of antimicrobial agent is depleted.

15. A flexible hygienic remote control enclosure for receiving and housing a wireless remote control device, comprising:

at least one sidewall having at least an inner surface, an outer surface, a distal end, and a proximal end, whereby the inner surface is circumferentially attached to itself substantially at the distal end forming a bottom wall and the proximal end is initially open through which the wireless remote control device is inserted; end a closure means to permanently seal the wireless remote control device in the enclosure, wherein the closure means includes at least one drawstring, having at least one engagement portion, slideably housed in a drawstring housing with the at least one engagement portion accessible, whereby the drawstring housing is attached substantially near to the at least one sidewall proximal end, and having at least one drawstring adhesive securing strip releasably covered with a removable protective strip, whereby the at least one sidewall proximal end is drawn closed when the at least one drawstring is drawn to a cinched position.

16. The flexible hygienic remote control enclosure of claim 15, wherein at least a portion of the at least one sidewall is affixed with sidewall indicia.

17. The flexible hygienic remote control enclosure of claim 15, wherein the closure means includes at least one adhesive securing strip, releasably covered with a removable protective strip, attached to the inner surface of the at least one sidewall between the distal end and the proximal end.

18. The flexible hygienic remote control enclosure of claim 15, wherein the closure means includes a sealing flap having an inner and outer surface, having at least one flap adhesive securing strip on the inner surface, releasably covered with a removable protective strip, flexibly attached to a portion of the outer surface of the at least one sidewall.

19. A flexible hygienic remote control enclosure for receiving and housing a wireless remote control device, comprising:

a bottom wall, at least transparent in part, having a peripheral edge;

at least one transparent in part sidewall having at least an inner surface, an outer surface, a distal end, and a proximal end, and having at least a portion of the at least one sidewall affixed with sidewall indicia, whereby the distal end is attached to the bottom wall peripheral edge and the proximal end is initially open through which the wireless remote control device is inserted, the sidewall and bottom wall further including an antimicrobial agent wherein the antimicrobial agent forms a surface coating on the at least one sidewall and the bottom wall and the antimicrobial agent exhibits migration through the at least one sidewall and the bottom wall as the surface coating of antimicrobial agent is depleted, at least one drawstring, having at least one engagement portion, slideably housed in a drawstring housing with the at least one engagement portion accessible, whereby the drawstring housing is attached substantially near to the at least one sidewall proximal end, whereby the at least one sidewall proximal end is drawn closed when the at least one drawstring is drawn to a cinched position; and a sealing flap having an inner and outer surface, having at least one flap adhesive securing skip on the inner surface, releasably covered with a removable protective strip, flexibly attached to the at least one sidewall outer surface, and the closure flap is affixed with flap indicia on the outer surface.

* * * * *